US005855452A

United States Patent [19]

Sagefors

[11] Patent Number: 5,855,452

[45] Date of Patent: Jan. 5, 1999

[54] METHOD FOR EXCAVATING ROCK CAVITIES

[76] Inventor: Karl Ivar Sagefors, PL 922, Öregrund S-740 71, Sweden

[21] Appl. No.: 719,007

[22] Filed: Sep. 24, 1996

Related U.S. Application Data

[63] Continuation of PCT/SE95/00324 Mar. 27, 1995.

[30] Foreign Application Priority Data

Mar. 27, 1994 [SE] Sweden ..... 9401055

[51] Int. Cl.[6] ..... E02D 29/00

[52] U.S. Cl. ..... 405/55; 405/53; 405/133

[58] Field of Search ..... 405/53–55, 132, 405/133, 138

[56] References Cited

U.S. PATENT DOCUMENTS

| | | | |
|---|---|---|---|
| 4,363,563 | 12/1982 | Hallenius et al. | 405/55 |
| 4,572,707 | 2/1986 | Sagefors | 405/55 |
| 4,708,523 | 11/1987 | Sagefors et al. | 405/55 |
| 5,104,259 | 4/1992 | Svensson | 405/55 |

FOREIGN PATENT DOCUMENTS

| | | |
|---|---|---|
| 410430 | 10/1979 | Sweden . |
| 7901278 | 8/1980 | Sweden . |
| 434969 | 8/1984 | Sweden . |
| 452785 | 12/1987 | Sweden . |
| 465171 | 8/1991 | Sweden . |

OTHER PUBLICATIONS

Sagefors et al., "An excavation method for large vertical cylindrical caverns", *Tunneling and Underground Space Tech.* 11: 279–285 (1996).

Sagefors et al., "An excavation method for Large Vertical Cylindrical caverns" (1996).

Sagefors et al, "An excavation method for Large Vertical Cylindrical caverns" (1995).

*Primary Examiner*—Tamara L. Graysay
*Assistant Examiner*—Tara L. Mayo
*Attorney, Agent, or Firm*—Oppedahl & Larson

[57] ABSTRACT

In a method for excavating rock cavities in the form of substantially cylindrical, vertical or low placed rock cavities for the storage of gas, fluid, solid products or for another purpose, one first, from a transport tunnel (2), excavates an upper circular room (3). From this circular room (3), one excavates the roof shape of the rock cavity (1) to be; and then, from a second transport tunnel (7) excavates a second annular tunnel (5) from a middle level in the rock cavity (1) to be. From the second transport tunnel (7), one also excavates a lower circular room (8) situated on a level which is substantially at the level where the lowest level of the rock cavity (1) to be, is. At this lowest level one excavates a third annular tunnel (13); between the circular room (8) and the third annular tunnel (13) provides tap holes (9). From the second annular tunnel (5), stopping is carried out in a substantially annular vertical or inclined zone from the middle level to the lowest level and removes blasted rock mass through the tap holes (9). One then separates a substantially conical roof volume (10) above the annular room (8) whereafter, finally, a remaining, central, substantially cylindrical rock pillar (14), substantially placed above the annular room (8), is blasted completely or partly at one or more events and rock mass obtained is removed via the tap holes (9).

4 Claims, 11 Drawing Sheets

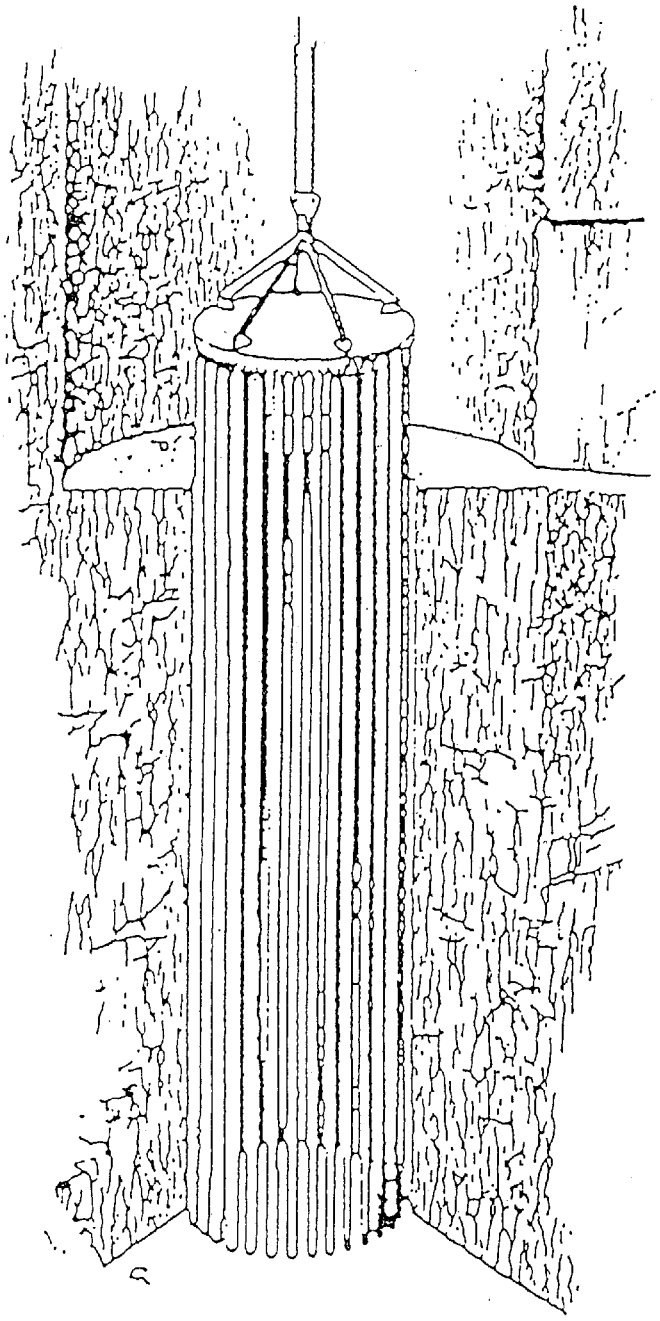
FIG 11
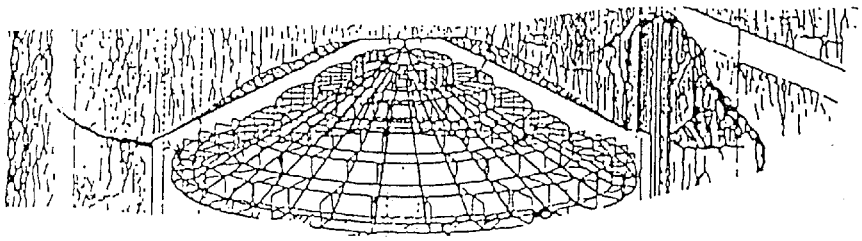

METHOD FOR EXCAVATING ROCK CAVITIES

This application is a continuation of International Application No. PCT/SE95/00324 filed Mar. 27, 1995 designating the United States.

DESCRIPTION

1. Technical Field

The present invention relates to a method for excavating rock cavities in the form of substantially vertical cylinders.

The object of the present invention is to obtain a possibility to excavate in a simple and rational way, and thereby less cost demanding way, rock cavities in the form of substantially vertical cylinders.

A further object of the invention is thereby to meet the requirements set by law concerning job environment set forward. The present invention has the object of providing a very good excavating technique of rock cavities where environmental conditions, ergonomics and security aspects cooperate to provide less cost demanding, ex cavated rock cavities in the form of substantially vertical cylinders.

2. Background of the Invention

It is previously known to store petroleum products and other liquids lighter than water in a cavity in ground water leading rock, whereby the stored liquid is directly resting against the water permeable wall surface of the hollow cavity. The liquid stored in the cavity is hindered from penetrating out through the water permeable wall surface as the pressure of the ground water counter acts the pressure of the liquid stored in the cavity. If the stored is lighter than water and insoluble in water it is common to arrange a water bed in the lower part of the cavity.

SE-A-7802027-8 and 7901278-7 disclose a formation for storing petroluem products and other fluids in rock, which formation has a very large storing capacity, although it has a relatively small extension in a horisontal plane. The product stored is thereby within a concentrated area and it is easier to protect the storing area using a tightly drilled hole curtain, in which the drilled holes are filled with water, to prevent a lowering of the ground water, whereby the product stored also is stopped from spreading to the environment of the formation.

According to the patents given above the rock cavities are situated on substantially the same depth and each cavity has in a horizontal cross-section a substantially circular or oval shape and seen in a horizontal cross-section through the entire formation the circular or oval horizontal sections of the cavities their centres situated in the corners of regular polygons which all have the same number of sides.

The term regular polygon means a polygon in which all sides have the same length and all corner angles are of equal size. A regular polygon can always be drawn inside a circle which passes through all corner points and the centre of which thus also is the centre of the polygon.

In one embodiment of the invention said polygons are pentagons having different sizes which are arranged with a common centre. The cavities will thus be arranged in concentric circles. A further cavity can be arranged in such a way that its centre axis coincides with the centre of these circles.

It is further known from SE-A-8300185-9 to produce a rock cavity for the storage of fluids, whereby there is a series of vertical holes made to produce a water deflecting curtain around the rock cavity as such, which cavity is in the form of a substantially vertical cylinder; in order to eliminate the water bed the fluid previously has been resting on.

At the storage of oil products in rock cavities rock cavities today are used which have the shape of long "loafs", i.e. horizontal rock cavities having a bottom surface or 500×35 m or more, and the height of 30 m. It has, however, turned out that the stored oil products in such rock cavities whereby the oil is resting on a water bed, microorganisms grow in the interface between water and oil, whereby oil/oil products are destroyed and their used is totally spoiled. At the storage of refined products it has turned out that rerefining must be carried out to guarantee the use of the product.

In order to solve this problem it has, as indicated above, previously been proposed to arrange for substantially cylindrical, vertical rock cavities. This has been described in i.a. the above denoted SE-A-790128-7 and the subsequent articles by K. I. Sagefors and co-workers, WP-System, Stockholm, Sweden. Hereby, it has been disclose that, at the excavation of the rock cavity, one starts from a top tunnel from which the roof dome in the shape of a cone is excavated by first drilling obliquely outwardly-downwardly along the surface of the cone, loading and blasting; that one excavates one or more transport tunnels ending in the cylindrical surface in the vertical rock cavity to be, from which transport tunnels excavation takes place by means of vertical drilling and stoping, whereby the blasted masses are removed from the bottom, which can be conically tapering downwards to a transport tunnel which can be used for pipe-laying and removal of stored product.

As mentioned above the methods previously proposed for the excavation of substantially cylindrical, vertical rock cavities have meant an excavation of a top tunnel from which drilling has taken place. Hereby it is necessary to establish a large uptake of drilling holes to distribute the blasting agent at the blasting in order to save the roof of the rock cavity from unnecessary stress. The driving of the top tunnel system also means that the rock above the rock cavity will be disturbed with a subsequent risk for reduced solidity.

By the growth of micro-organisms in the interface between product stored and water present as discovered, requirements have been raised for a minimizing of the amount of water present, whereby it has been proposed to totally line the surfaces of the rock cavity using a sealing agent, such as several layers consisting of spray concrete, fortified spray concrete, epoxy resins, glass fibre web, and further epoxy resin. Such a lining method is disclosed by Beckers-Sigma, different COLTURIET products.

It is, however, uncertain if such a lining can provide a lasting protection if a continous water pressure is present on the rock side of the lining. In order to guarantee the lasting of the lining further actions have thus been proposed to eliminate the surrounding water. (SE-A-8300185-9).

By means of the stoping mentioned above the influence on the remaining rock wall will become too large, bolting and further lining will be very costly for obtaining a lasting result. Stoping also means that micro fractures will be obtained in the wall of the rock cavity, which introduce water from the neighbouring rock.

Stop heights above 25 m leads larger drill hole deviations which in practise are compensated for by using larger load amounts in the drilled holes, which in turn however, results in an uneven wall surface and instability of the wall of the rock cavity, whick leads to a job environmetal risk.

Job environmental reasons and cost efficiency have thus raised the requirements for a new method for excavating vertical rock cavities.

SE-C-452,785 discloses a method for excavating rock cavities of the above mentioned type, whereby one, from a transport tunnel, excavates an upper circular room having a larger outer diameter than the substantially vertically extending part of rock cavity to be, on a level which is situated above the highest roof level of the rock cavity to be; that one, from a second transport tunnel, excavates a lower circular room having a larger outer diameter than the substantially vertically extending part of the rock cavity to be, on a level which is substantially on the level where the lowest level of the rock cavity to be, shall be placed; that one connects these circular rooms by excavating a vertical centre shaft and by excavating at least three vertical shafts in the periphery of the rock cavity to be; that horizontal drilling is carried out from the central shaft into the central rock mass of the rock cavity to be; that horizontal drill holes are made in the outer rock mass along the surface of the rock cavity to be from the vertical peripheral shafts, which horizontal drill holes are made to form a polygon in a horizontal cross-section through the rock cavity to be; that oblique drilling is made from said peripheral shafts for the formation of a conical roof dome, or conical bottom profile, respectively, whereupon blasting takes place from below and upwards to the formation of a polygonal vertical rock cavity.

Thereby it is achieved that the walls of the rock cavity is saved from serious formation of cracks. Further, it is achieved that all drilling takes place from the vertical shafts whereby the drillers are standing protected in the shafts and will never enter, the rock cavity.

Drilling and blasting are carried successively from below and upwards. A continous loading-up is done in the bottom and no men are exposed to risks for fall downs or stones falling down.

Previously disclosed methods for excavating vertical rooms (SE-C-7802027-8; SE-C-7901278-7) can not be regarded to fulfill the requirements of a good job environment.

SUMMARY OF THE INVENTION

It has now surprisingly turned out to be possible to rationalize the excavation of substantially vertical, cylindrical rock cavities by means of the present invention, which is characterized in that one, from a transport tunnel, excavates an upper annular or circular room, that one, from this circular room, excavates the roof shape of the rock cavity to be; that one, from a second transport tunnel excavates a second annular tunnel from a middle level in the rock cavity to be; and that one, from said second transport tunnel, excavates a lower circular room situated on a level which is substantially at the level where the lowest level of the rock cavity to be, is, that one, at this lowest level excavates a third annular tunnel; that one, between said circular room and said third annular tunnel provides tap holes; that one, from said second annular tunnel, carries out stoping in a substantially annular vertical zone from said middle level to said lowest level and removes blasted rock mass through said tap holes, whereafter, finally, a remaining, central, substantially cylindrical rock pillar is blasted completely or partly in one or more bursts and rock mass obtained is removed via said tap holes.

If the rock cavity has a very large height, 100 m or more, a further annular tunnel is provided in a level in-between starting from the inclined transport tunnel.

BRIEF DESCRIPTION OF THE DRAWINGS

The present invention will be described more in detail below with reference to the attached drawing, wherein

FIG. 11 introduction of a platform in the centre shaft;

DETAILED DESCRIPTION OF THE INVENTION

Figure 1:
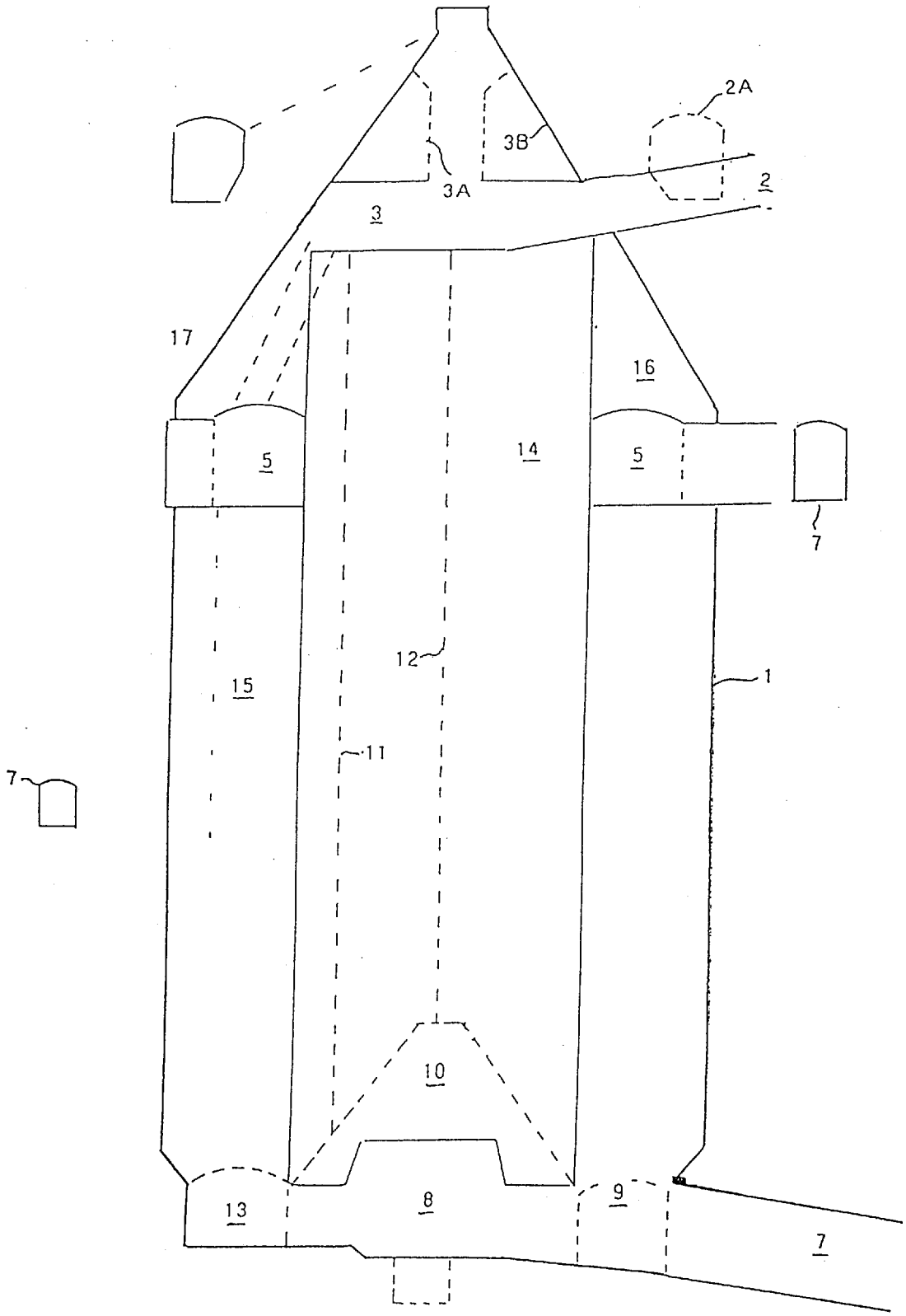
FIG. 1 shows a vertical section through a preferred embodiment of a rock cavity excavated in accordance with invention.
Figure 2:
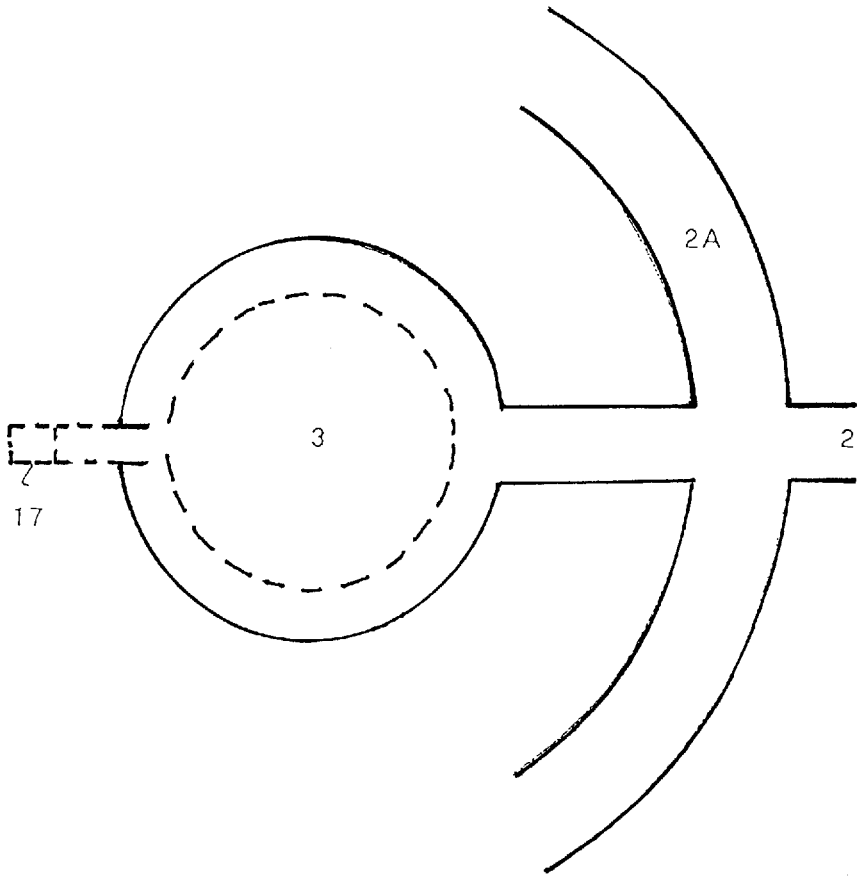
FIG. 2 shows a horizontal section through the upper part of the rock cavity according to FIG. 1.
Figure 4:
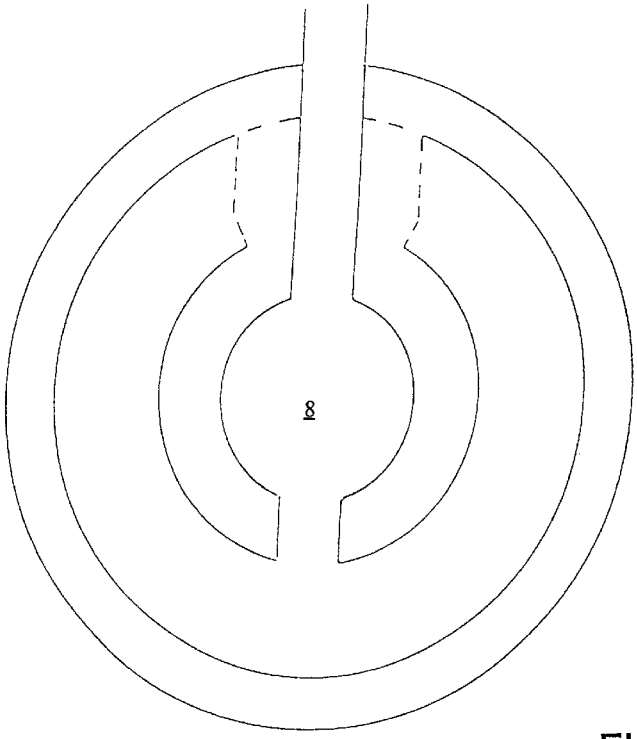
FIG. 4 shows a horizontal section through the lower part of a rock cavity according to FIG. 1.
Figure 3:
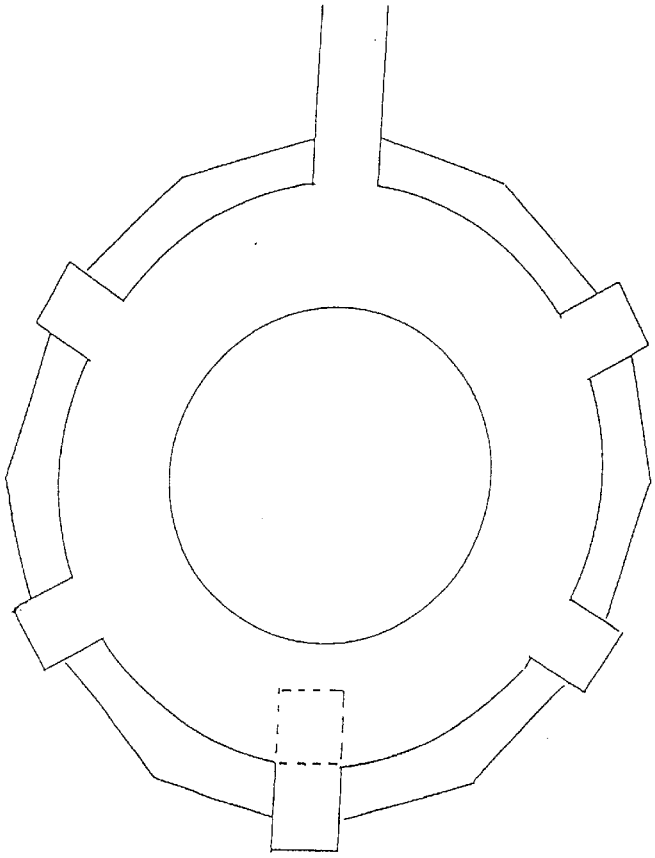
FIG. 3 shows a horizontal section through the embodiment of FIG. 1.
Figure 5:
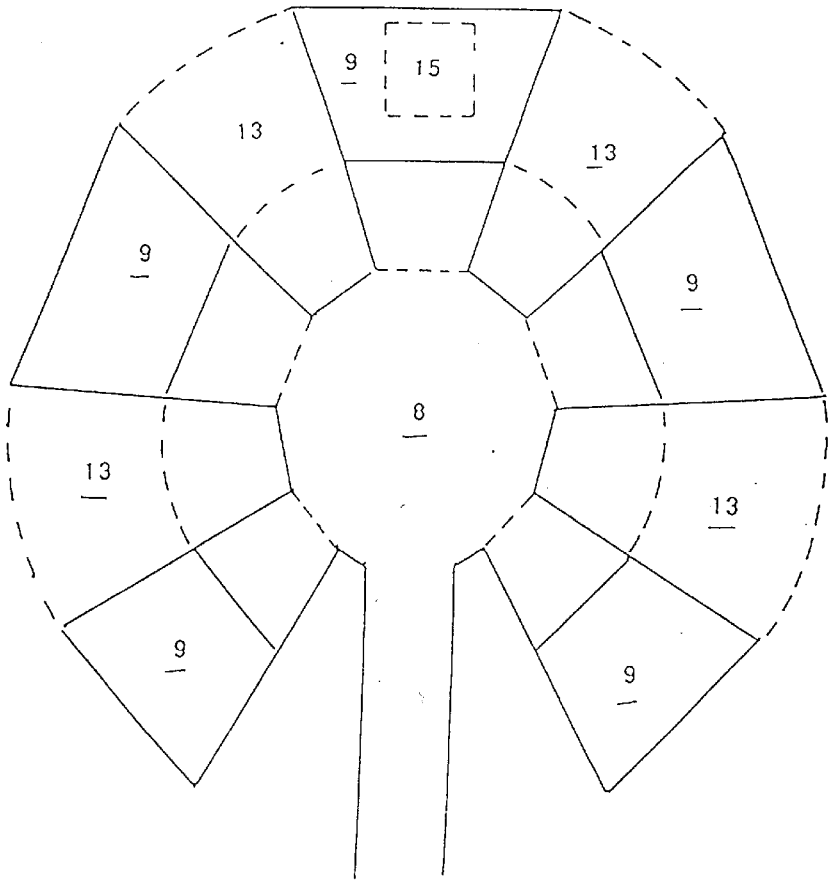
FIG. 5 shows a horizontal section of rooms in the centre with a connecting tunnel to tap holes.
Figure 6:
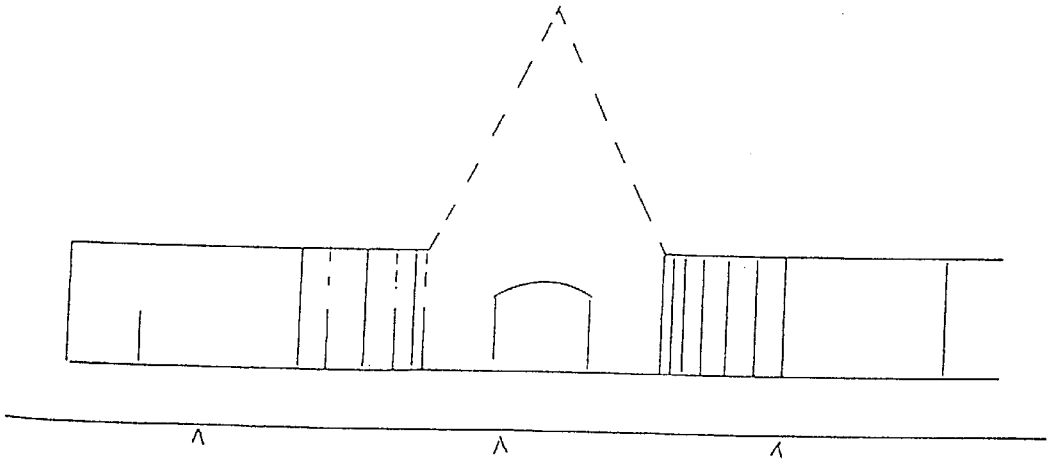
FIG. 6 shows a detail in vertical section through the lower part of a rock cavity according to FIG. 1.
Figure 7:
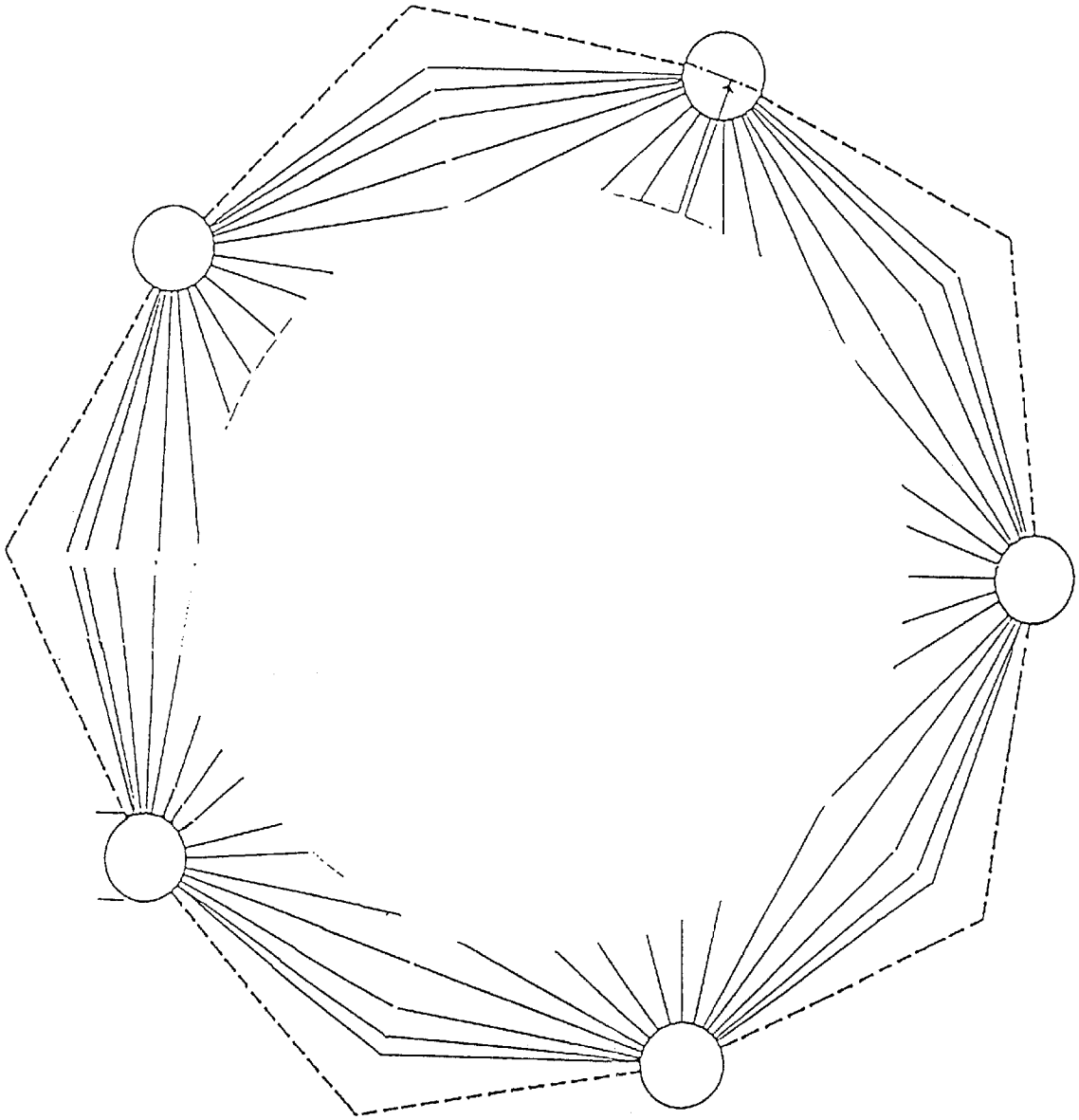
FIG. 7 shows horisontal drilling from the peripheral shafts after having blasted the centre pillar.
Figure 8:
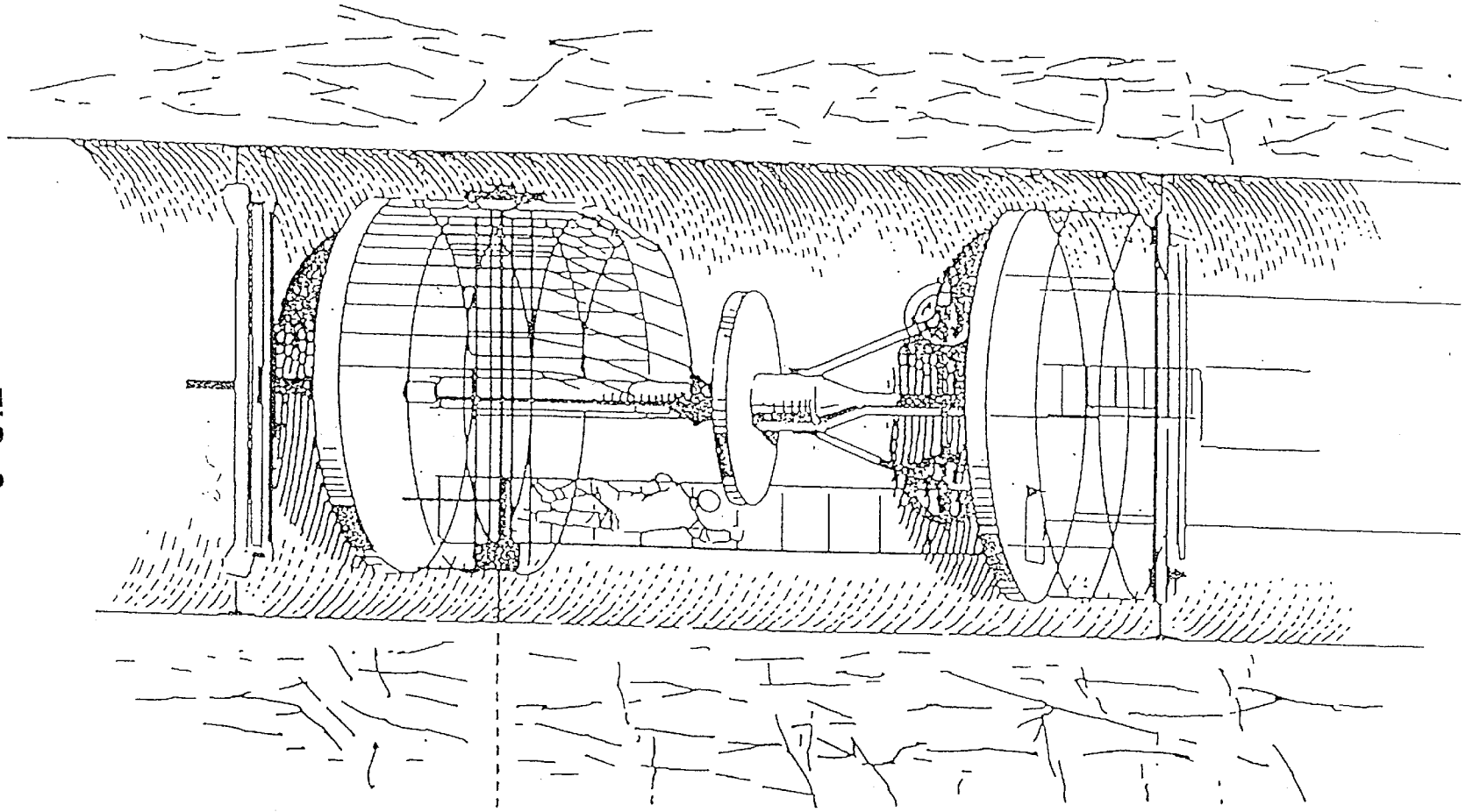
FIG. 8 devices in the shafts.
Figure 9:
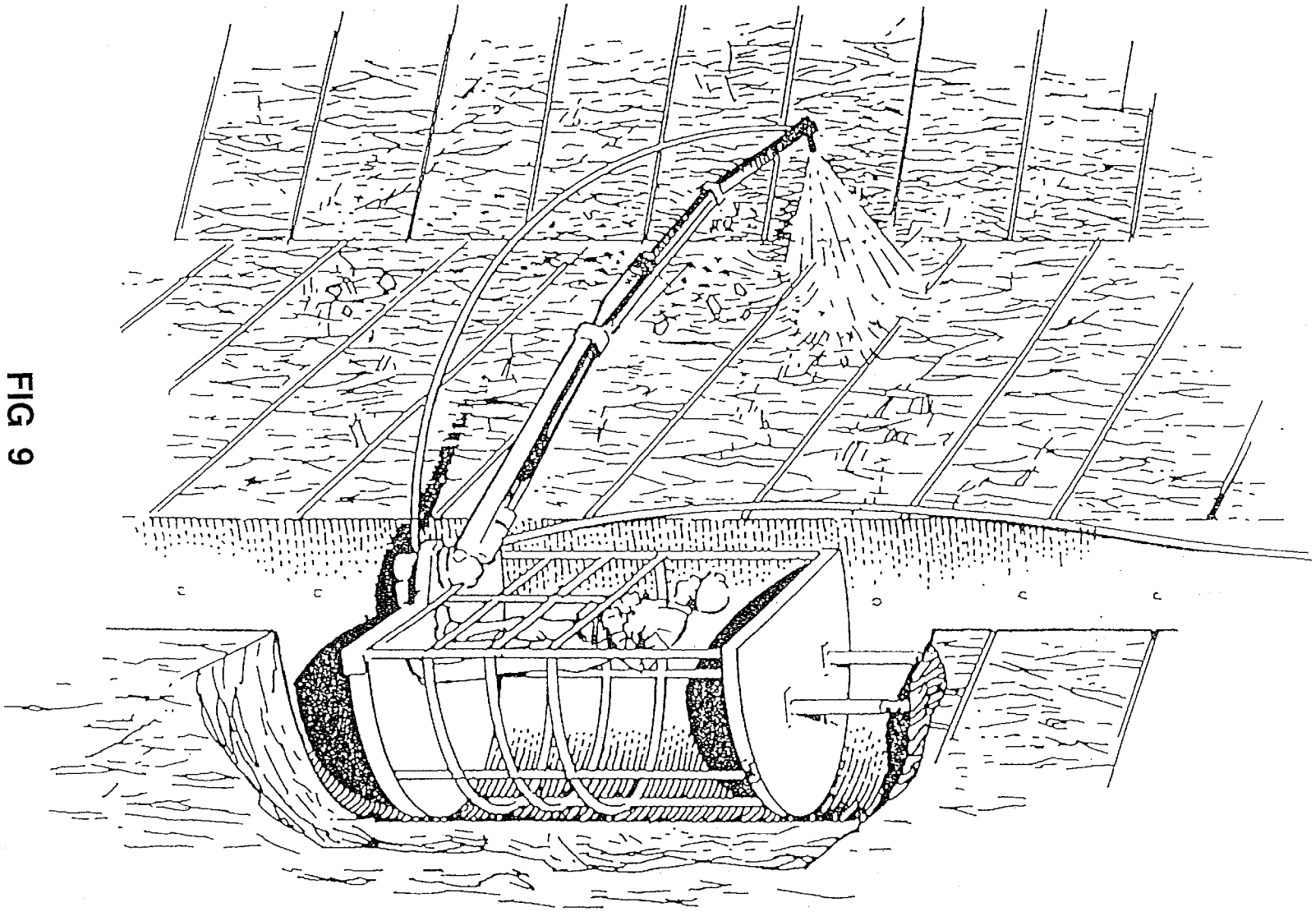
FIG. 9 cleansing using water under high pressure.
Figure 10:
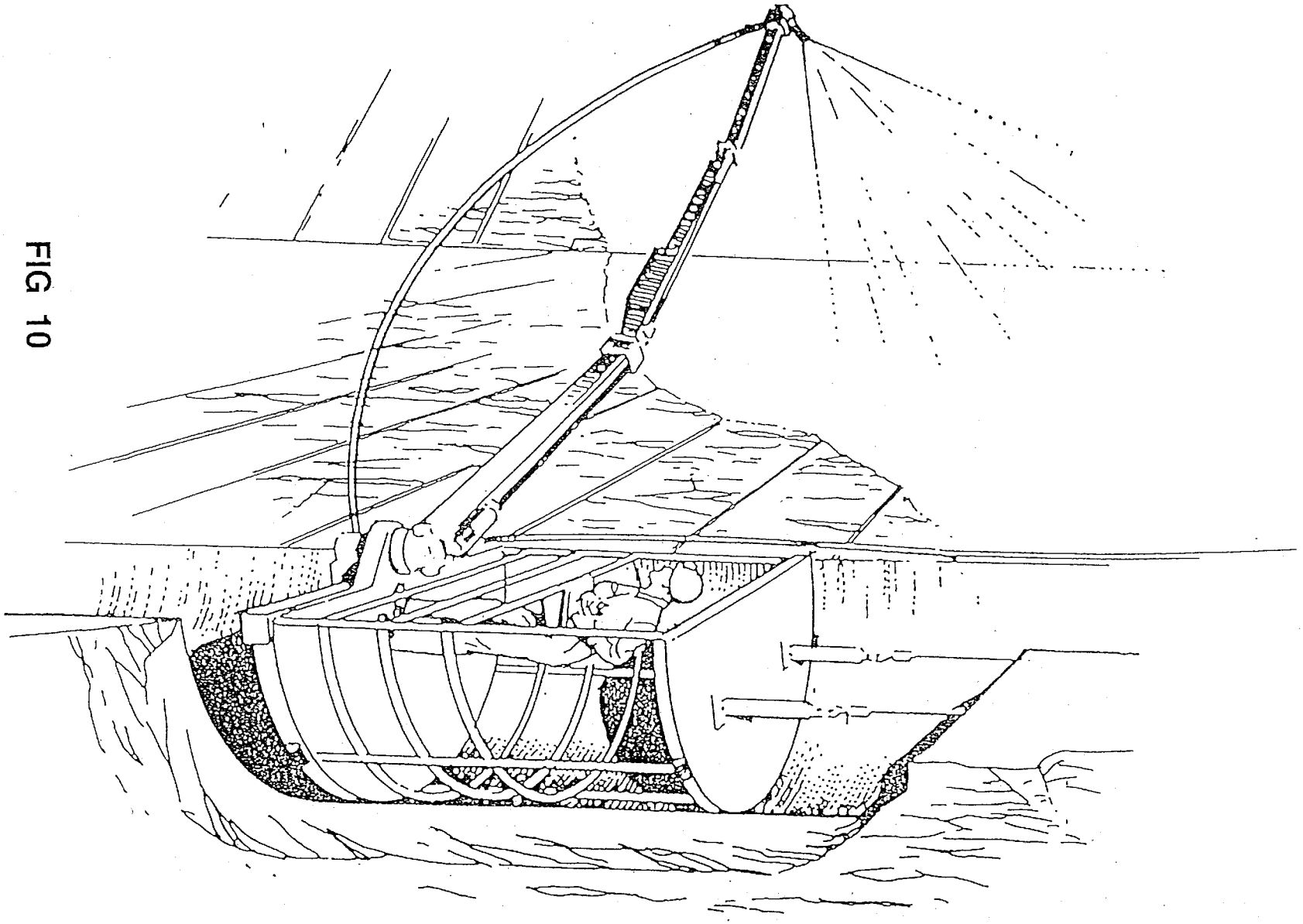
FIG. 10 treatment with spray concrete.
Figure 12:
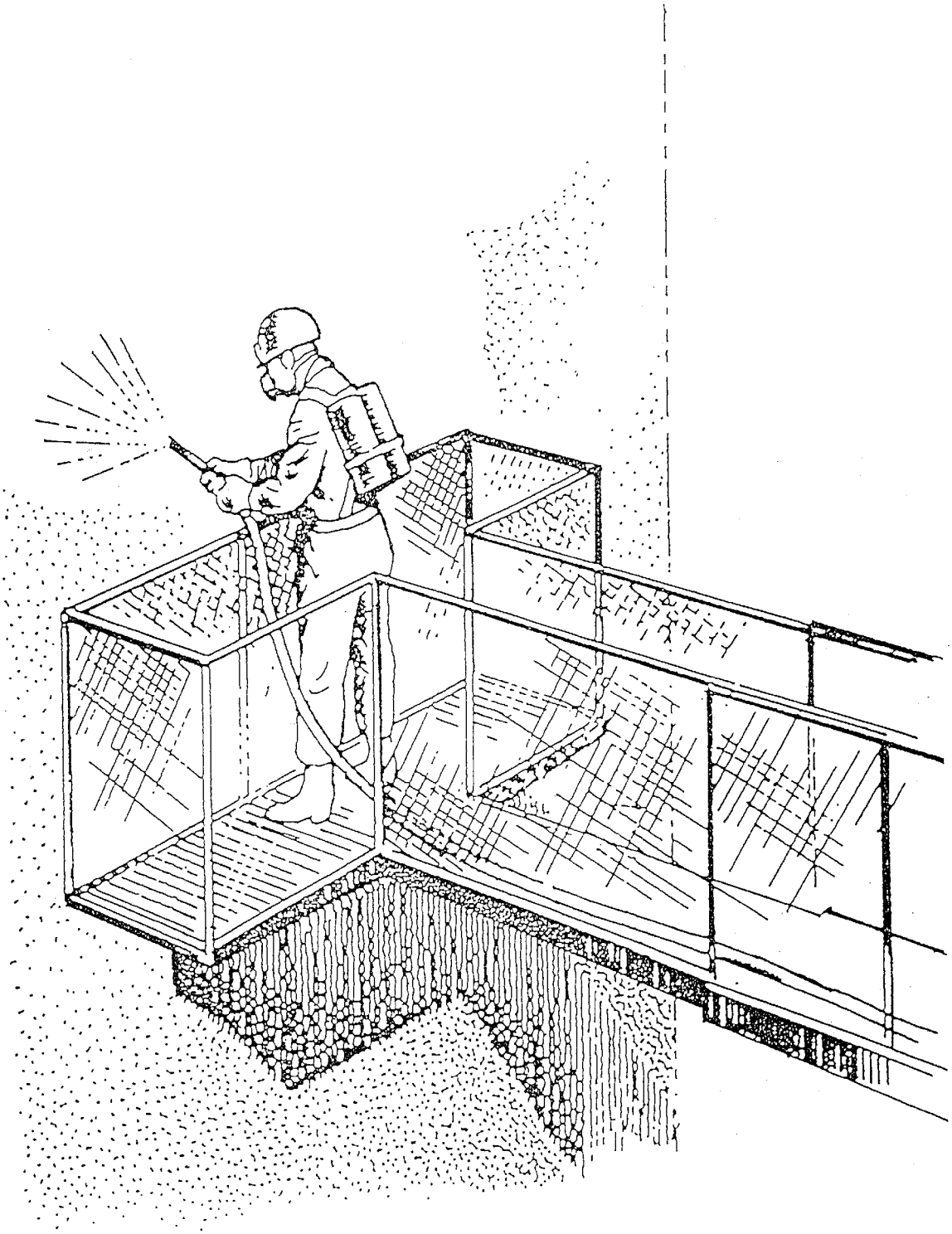
FIG. 12 treatment with resins.
Figure 13:
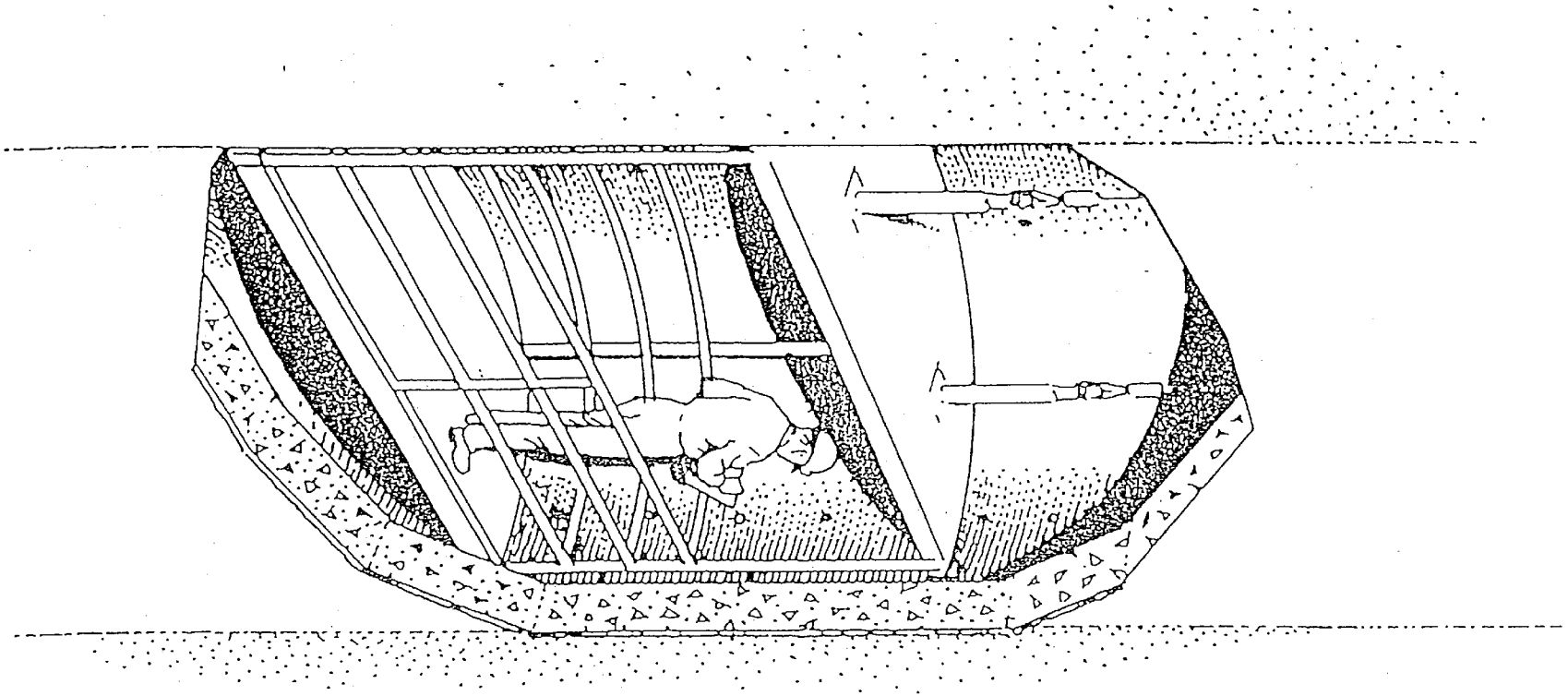
FIG. 13 inspection of drainage.

1 denotes a surface of a future substantially cylindrical, vertical rock cavity. The rock cavity has preferably a polygonal cross-section in a horizontal section (in the present case a dodecagonal shape). The final outer contour of the rock cavity has been drawn with a heavy black line, whereby other lines, either fully drawn lines or broken ones denotes shapes and lines during excavation. A transport tunnel 2 ends in a annular or circular room 3, which has a diameter, at least outer diameter which corresponds to the future dome part of the rock cavity in this part. From the transport tunnel 2 this annular tunnel or circular room 3 has been excavated, and from which a raising shaft 3A is drilled, the outer contours or the top cone which is blown downwards 3B. An annular tunnel 2A is excavated outside the future rock cavity in order to allow mechanical bolt/wire enforcement of the roof cone from this. From the annular or circular room drilling is carried out downwards along the roof cupola to a second annular tunnel 5. Simultaneously, as the transport tunnels 2 and the annular tunnel 5 is excavated, a second inclined transport tunnel 7 is excavated which leads down to the bottom level of the future rock cavity. From here a second circular room 8, from which five transport tunnels are excavated to tap holes 9. A third annular tunnel 13 is excavated at the lowest level along the somewhat in-drawn outer contour of the rock cavity 1. In the present case parallel trapezium shaped tap holes are excavated. The tap holes can be tunnel shaped without trapezium form as well. From the annular tunnel 5 a vertical drilling is carried out downwards for blasting and transport away of blasted rock masses through the tap holes 9. Hereby so called stop blasting takes place when the room has a small volume, i.e. in this case 25 m holes in a wall, which holes can be drilled with great precision. At high room heights where the stop height can amount to 100 m and the walls are to be coated with spray concrete and resins high requirements of surface smoothness and peripheral shafts, as e.g. according to SE-C-452 785, and thereby the handling is carried through as evident from FIGS. 7 to 11.

Disc stop blasting according to FIG. 1 is started towards a raising shaft 15.

From the tap holes 9 and the annular tunnel 13 drilling is also carried out obliquely upwards-inwards to the formation of a cone 10 above the circular room 8. This cone is pre-cracked (is separated) from the above lying central cylindrical rock body 14. The pre-cracking hereby provides a smooth rock surface to which the masses can move and slide downwards towards the tap holes 9. Simultaneously as stop excavation takes place of the rock mass from the annular tunnel 5 a number of vertical ring holes 11 are drilled from the circular room 3, whereby at larger room diameters several ring holes are drilled in the central rock mass as well as one or three vertical holes 12 in the centre down to the cone 10 above the circular room 8. When the rock mass below the annular tunnel 5 has been blasted by means of said stoping to the lowest level, then the lowest 10 meters 16 of the area around the centre pillar is blasted, exclusive of the area which concerns the width of the transport tunnel 2 into room 3. The start of the blasting takes place towards a raising shaft 17, where upon the holes 11 and 12 are loaded and the central rock mass is blasted in one or more events. The blasted rock mass is then transported away via the tap holes 9 by means of loading machine in the circular room 8 and trucks through the transport tunnel 7.

By means of the invention it is achieved that considerable production drilling can take place on the different upper levels while the transport tunnel 7 down to the lower level is excavated, which, using a level difference of 35 m in this example and a total length from the middle level (tunnel 5) takes about one month. The preparation of the circular room 8 including the tap holes 9 takes about one month, whereafter stoping can be carried out with transport out of the large volumes. The tunnel 5 is gone. admission to the top or the stop is now allowed from tunnel 2 with the small wall (the rock edge supporting the centre pillar in the cone of the room). That is to say that as soon as the small amounts of rock masses are gone in room 3 and the roof dome has been excavated the production drilling of the whole centre pillar can take place. Thereby a great gain of time is obtained as to working plane. By blasting the whole central rock mass in one event about 22% of the mass can be blown in one event in a rock cavity encompassing 60,000 $m^3$ and using normal dimensions (diameters and tunnel widths). At a diameter of 60 m the centre pillar encompasses 60 to 80 000 $m^3$, whereby it is revolutionary that the work on such large volumes can be carried out in peace and quitness in the relatively small roof dome. This is extremely unique. Transporting away below the cone 10, which provides for great safety as to working environment. By arranging a number of tap holes 9 (transport tunnels) which can be more than 5 at larger diameters of the rock cavity, loading/transporting away can be carried out continously, Stoping incl. blasting can be carried out above a tap hole 9 while one removes blasted mass from another. For sealing of the rock outside the cavity vertical holes are drilled from the upper annular tunnel 2A straight downwards through the rock to a level equal to the bottom level of the rock cavity. Before blasting the rock cavity these drill holes are injected with a sealing agent which penetrates into micro and macro cracks in the rock.

Subsequent to the transporting out of rock masses the cleansing apparatus is lowered down into the peripheral shafts or along the wall. This relates to the reduced feeling of giddiness of those carrying out the work. The spraying of concrete work follows and if the room is to be treated the transporting away can be regulated subs sequent to this other work.

The rock masses blown can after transporting away be replaced with sand or another filling material which is easily handled, so that the larger part of the volume of the rock cavity is filled up. Then working platforms are adapted hanging from the roof along the sides of the rock cavity on or in the vicinity of the sand or filling material. Enforcement and lining work are carried out and the filling material is transported away through the tap holes 9 subsequent to making the enforcement and lining works ready.

When the sand layer reaches 1 to 2 meters above the top of the cone 10 the whole rock cone can be blown in one event. The sand is then a splinter protection and further storage space can be obtained. When the rock cavity is completely excavated one can simply cleanse the rock by lowering, in the peripherally arranged shafts, lift baskets on which high pressure spraying equipment has been arranged.

Then the rock can, if a more tight rock should be wanted, be treated with spraying concrete from the same lift baskets as from which cleansing took place.

In certain cases at the storage of jet fuel for civilian and military jet aircrafts completely tight rock cavities are wanted for the total elimination of water present, exclusive of condensing water. Hereby the rock cavity wall is covered with a resin above the spray concrete, suitably from a unfolded/collapsible platform which is lowered down from the opening of the centre shaft and where working platforms are present from which the work is done.

For elimination of the water pressure from the surrounding rock drainage of the rock may be necessary. A suitable placement is evident from SE-C-452,785, which is hereby incorporated as a reference.

Depending on the type of fluid stored and wall heights, i.e. room volume, the vertical shafts can be part or not of the storage, through which the fluid can be pumped away using (not shown) tubes. At the storage of crude oil the whole tunnel and shaft system can be used whereby a stopper is introduced in the tunnel 7 and tunnel 2, through which tubes are drawn for pumping away the oil.

The erection is compact and requires a minimum of ground area. Also within limited areas one can thus build very large storages. The area of the storage site becomes minimal. It is then more easy to produce those constructions which are needed to avoid lowering of the ground water in the surroundings. The geometric design of the erection makes it easy to arrange injection and water contains outside the erection, all depending on the requirements set forth. These water curtains consists of rows of drilled vertical holes which are filled with water. Using these water curtains the ground water level within and outside the rection can be maintained in a simple way. The concentrated area which is taken by the erection makes it more easy to place the erection within a homogenous rock part whereby disturbances of the surroundings are more easily avoided.

As each rock cavity has a height which is larger than its diameter the bedrock in which the erection is placed to be better utilized in the depth, which provides for a possibility for a more compact erection and better economy concerning the utilization of the ground area, and if the product stored is heated a better heat economy is achieved as well.

Due to the height of the rock cavities enough pressure height on the product stored is obtained so that this can be removed using the pumps arranged within or below the rock cavities. The extensiveness of tube installation needed becomes less due to the compact design of the erection.

If the product stored shall be heated the heat can be added in a desired part of the rock cavity and at the desired level.

If the products stored deposit sludge, this can easily be collected and pumped away continously at the erection, and it is not necessary to arrange large volumes for the final deposition of the sludge in the bottom of the erection.

Further, the form of the rock cavities makes it more easy to place transducers for the control equipment, e.g. temperature sensosrs and level sensors and the similar.

In the case the erection is used as an indutrial space transports of materials can be done using a traverse from the tunnel 2 or 2A.

For the sealing the rock a sealing material can be injected through drilled holes as mentioned above, whereby this is doen preferably in advance of the blasting excavation of the cavity. Type of sealing material can be silica elstomer and others.

As the space is dry it is, beside the above mentioned areas of use, also suited for the storage of gas, cereal grains, such as wheat, barley, rye, and oat, and for the storage of low and medium high waste materials from the nuclear power plants and nuclear research stations.

By means of the present rock cavities an elimination of all problems known today within the oil storage technology is obtained. The possibility of pumping out oil stored compared to horisontal storage caverns provides for a volume profit in the storage, which can be calculated to several 100s of millions of crowns in a large storage during a time of use of 20 years.

By means of the present process a rapid excavation method, exact contour drilling, optimal starting of injection holes is obtained, whereby about 80% of the drilling work can be doen continously, divided into 40% disc stop and 40% large stop (centre pillar) transport away of about 80% of the rock masses can be done during continous work, working environment and ergonometri are improved, a conserable time gain at the construction compared with conventional technique and considerably lower blasting costs.

I claim:

1. A method for excavating a rock cavity comprising the steps of (a) excavating through a first transport tunnel a circular or annular upper room located near the top of the rock cavity;

(b) excavating from the upper room the roof shape of the rock cavity;

(c) excavating through a second transport tunnel a middle annular tunnel located at a middle level of the rock cavity;

(d) excavating from the second transport tunnel a lower circular room located at substantially the lowest level of the rock cavity;

(e) excavating a lower annular tunnel surrounding the lower circular room at substantially the lowest level of the rock cavity;

(f) forming tap holes connecting the lower circular room to the lower annular tunnel;

(g) from the middle annular tunnel stoping in a substantially annular vertical or inclined zone from the middle level to the lowest level and removing blasted rock mass through the tap holes; and (h) separating a substantially conical roof volume above the lower circular room, such after performing steps (a) through (h) there remains a central, substantially cylindrical rock pillar above the lower circular room; and (i) blasting the cylindrical rock pillar in one or more blasting events, and removing the resulting rock mass through the tap holes to form the rock cavity.

2. The method according to claim 1, further comprising the steps of partially filling the partially formed rock cavity with sand at one or more intermediate stages during the excavation.

3. The method according to claim 2, wherein the partially formed rock cavity is filled with sand to a height above the top of the conical roof volume prior to performing step h.

4. The method according to claim 2, further comprising the step of introducing platforms for performing enforcement or lining work after the partially formed cavity has been filled with sand.

* * * * *